US008932369B2

(12) United States Patent
Miller et al.

(10) Patent No.: US 8,932,369 B2
(45) Date of Patent: Jan. 13, 2015

(54) METHOD AND APPARATUS FOR DETERMINING AN UNBALANCE CONDITION IN A LAUNDRY TREATING APPLIANCE

(75) Inventors: Christoph J. Miller, Saint Joseph, MI (US); Paul F. Spindler, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 784 days.

(21) Appl. No.: 12/902,181

(22) Filed: Oct. 12, 2010

(65) Prior Publication Data

US 2011/0247146 A1 Oct. 13, 2011

Related U.S. Application Data

(60) Provisional application No. 61/323,787, filed on Apr. 13, 2010.

(51) Int. Cl.
*D06F 33/00* (2006.01)
*D06F 37/20* (2006.01)
*D06F 35/00* (2006.01)

(52) U.S. Cl.
CPC ..... *D06F 37/203* (2013.01); *D06F 35/007* (2013.01)
USPC ..... 8/137; 68/12.02; 68/12.06; 68/12.27

(58) Field of Classification Search
CPC ..... D06F 37/203; D06F 35/007
USPC ..... 8/159, 137; 68/12.06, 12.27
See application file for complete search history.

(56) References Cited

U.S. PATENT DOCUMENTS

| | | | | |
|---|---|---|---|---|
| 5,970,555 | A | 10/1999 | Baek et al. | |
| 6,047,428 | A | 4/2000 | Min | |
| 6,418,581 | B1 * | 7/2002 | Bruce et al. | 8/159 |
| 6,550,290 | B2 | 4/2003 | Shimakage et al. | |
| 7,246,397 | B2 | 7/2007 | Kim et al. | |
| 7,251,848 | B2 | 8/2007 | Kim et al. | |
| 7,412,740 | B2 | 8/2008 | Park et al. | |
| 7,451,510 | B2 | 11/2008 | Lee | |
| 8,627,688 | B2 * | 1/2014 | Volpato et al. | 68/12.06 |
| 2001/0052265 | A1 | 12/2001 | French et al. | |
| 2002/0016997 | A1 | 2/2002 | Jonsson | |
| 2004/0068804 | A1 | 4/2004 | Kim et al. | |
| 2004/0181882 | A1 * | 9/2004 | Kim et al. | 8/158 |
| 2006/0242768 | A1 * | 11/2006 | Zhang et al. | 8/159 |
| 2006/0260066 | A1 | 11/2006 | Kim et al. | |
| 2007/0039106 | A1 * | 2/2007 | Stansel et al. | 8/159 |
| 2007/0044247 | A1 | 3/2007 | Park et al. | |
| 2007/0050918 | A1 | 3/2007 | Kim et al. | |

FOREIGN PATENT DOCUMENTS

| | | | |
|---|---|---|---|
| EP | 313339 | A1 * | 4/1989 |
| EP | 903845 | A2 * | 3/1999 |
| EP | 1113102 | A1 * | 7/2001 |
| EP | 1167609 | A1 | 1/2002 |
| GB | 2322141 | A | 8/1998 |
| KR | 20010002625 | B1 | 1/2001 |
| KR | 20080102611 | A | 11/2008 |
| WO | 2007/114671 | A2 | 10/2007 |

* cited by examiner

*Primary Examiner* — Joseph L Perrin
*Assistant Examiner* — Kevin G Lee

(57) ABSTRACT

An apparatus and method for determining an unbalance condition in a laundry treating appliance having a rotating drum based on the rotational speed of the drum.

26 Claims, 5 Drawing Sheets

METHOD AND APPARATUS FOR DETERMINING AN UNBALANCE CONDITION IN A LAUNDRY TREATING APPLIANCE

CROSS REFERENCE TO RELATED APPLICATIONS

The present application claims the benefit of U.S. Provisional Patent Application No. 61/323,787, filed Apr. 13, 2010, which is incorporated herein by reference in its entirety.

BACKGROUND OF THE INVENTION

Laundry treating appliances, such as a washing machine, may implement cycles of operation in which a drum defining a treating chamber for receiving a laundry load is rotated at high speeds, such as a spin or water extraction phase. To extract the water from the laundry load, the drum is typically spun at high speeds. If a sufficiently large enough load imbalance is present, the laundry treating appliance may experience undesirable vibrations and movements when the drum is rotated at high speeds during the spin phase.

Paddle switches have been used to address the issue of excessive vibrations from imbalances. The paddle switches trip at a fixed level of movement; however, these types of switches are expensive and do not perform well when the laundry treating appliance is installed on an unlevel surface.

BRIEF DESCRIPTION

According to one embodiment of the invention, a method of determining an unbalance condition of a load of laundry in a laundry treating appliance having a rotatable drum drivingly coupled with a motor operably coupled to a controller to control the motor and thereby control a rotational speed of the drum comprises accelerating the rotational speed of the drum according to an acceleration rate profile having at least one predetermined rate of acceleration to define an acceleration phase and repeatedly sensing the rotational speed of the drum during the acceleration phase to form a speed signal. The speed signal may be input to the controller and a second derivative of the speed signal may be repeatedly determined over time. The second derivatives may be accumulated and an unbalance condition may be determined as a function of the accumulated second derivatives satisfying a predetermined threshold. The rotation of the drum may be controlled as a function of the determined unbalance condition.

DESCRIPTION OF EMBODIMENTS OF THE INVENTION

Figure 1:
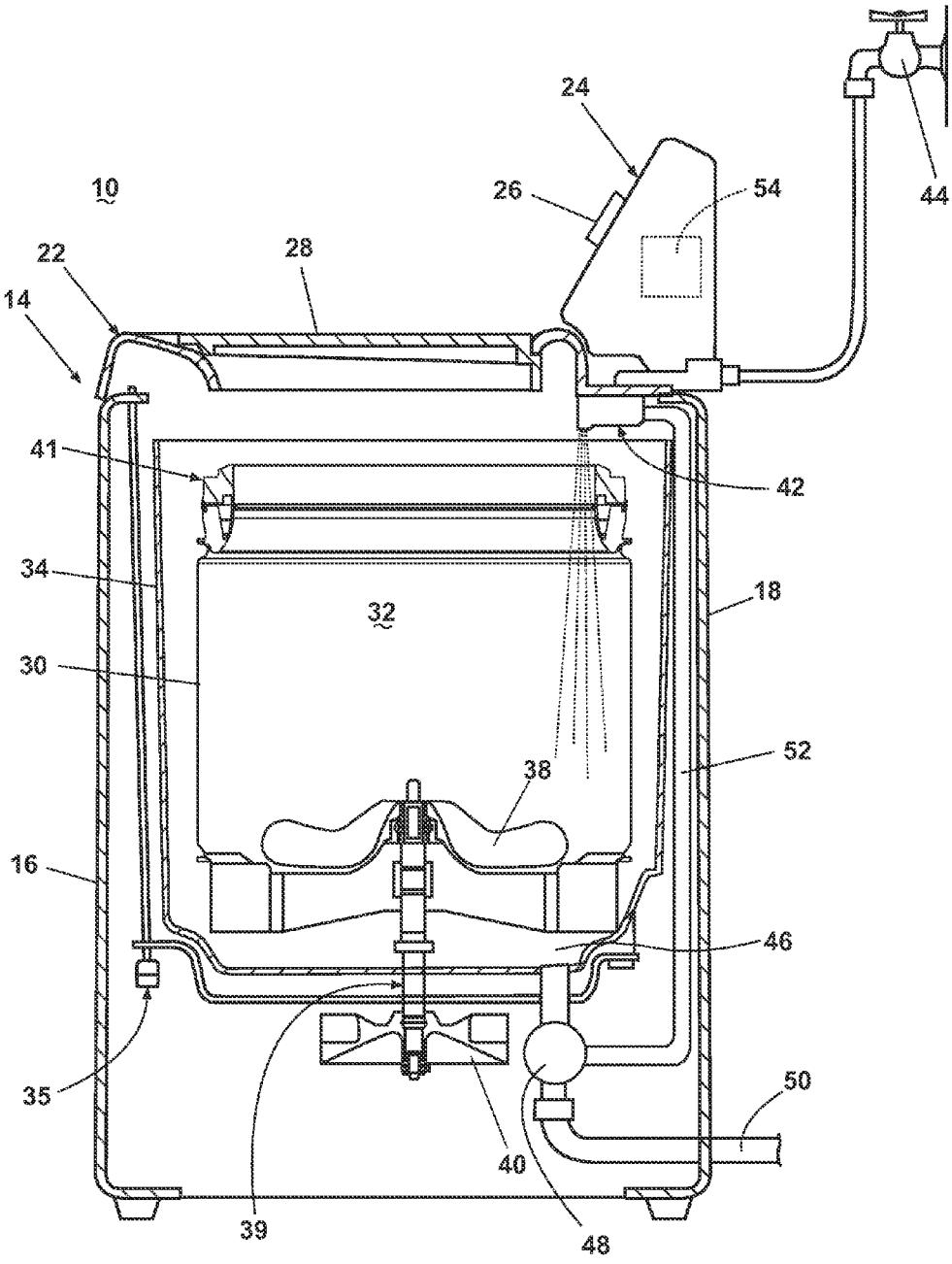
FIG. 1 is a perspective view of a laundry treating appliance according to one embodiment of the invention with a portion cut-away to show interior components of the laundry treating appliance.

FIG. 1 is a perspective view of a laundry treating appliance 10 in the form of a washing machine according to one embodiment of the invention. The laundry treating appliance may be any machine that treats articles such as clothing or fabrics. Non-limiting examples of the laundry treating appliance may include a horizontal or vertical axis washing machine; a horizontal or vertical axis dryer, such as a tumble dryer or a stationary dryer; a tumbling or stationary refreshing/revitalizing machine; an extractor; a non-aqueous washing apparatus; and a revitalizing machine. The laundry treating appliance 10 described herein shares many features of a traditional automatic washing machine, which will not be described in detail except as necessary for a complete understanding of the invention.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

As illustrated in FIG. 1 the laundry treating appliance 10 may have a cabinet 14 defined by a front wall 16, a rear wall 18, a pair of side walls (not shown) and supporting a top wall 22. A user interface 24 on the cabinet 14 may have multiple controls 26, which may be used to select a cycle of operation. A chassis (not shown) may be provided, with the walls mounted to the chassis.

The top wall 22 may have an openable door or lid 28 and may be selectively moveable between opened and closed positions to close an opening in the top wall 22 which provides access to the interior of the cabinet 14. A rotatable drum 30 may be disposed within the interior of the cabinet 14 and defines a treating chamber 32 for treating laundry. The drum 30 may be positioned within an imperforate tub 34, which is suspended from the cabinet 14 by a suitable suspension system 35. The drum 30 may include a plurality of perforations (not shown), such that liquid may flow between the tub 34 and the drum 30 through the perforations. A clothes mover 38 may be located in the drum 30 to impart mechanical agitation to a load of laundry placed in the drum 30.

The drum 30 and/or the clothes mover 38 may be driven by an electrical motor 40 operably connected to the drum 30 and/or the clothes mover 38 by a drive shaft 39. The clothes mover 38 may be oscillated or rotated about its axis of rotation during a cycle of operation in order to produce high water turbulence effective to wash the load contained within the treating chamber 32. The motor 40 may be any suitable type of motor for rotating the drum and/or the clothes mover. In one example, the motor 40 may be coupled to the drive shaft 39 through a belt to rotate the drum 30, as is known in the art. In another example, the motor 40 may be a brushless permanent magnet (BPM) motor having a stator and a rotor. Other motors, such as an induction motor or a permanent split capacitor (PSC) motor, may also be used. The motor 40 may rotate the drum 30 at various speeds in either rotational direction.

The laundry treating appliance 10 may also include a balance ring 41 coupled with an upper end of the drum 30 to offset an imbalance that may occur in the treating chamber 32 during rotation of the drum 30 during a cycle of operation. The balance ring 41 may be coupled with the drum 30 using any suitable mechanical and/or non-mechanical fastener, non-limiting examples of which include spring-clips, screws, and adhesives. The balance ring 41 may include upper and lower chambers that may be partially filled with fluid, such as water, salt water, oil or other viscous fluid, for example, and optionally, one or more moveable weights, such as spherical balls, for example. Alternatively, the balance ring 41 may include a single chamber that may be partially filled with a fluid, such as water, salt water, oil or other viscous fluid, for example, and optionally one or more moveable weights.

While the illustrated laundry treating appliance 10 includes both the tub 34 and the drum 30, with the drum 30 defining the treating chamber 32, it is within the scope of the invention for the laundry treating appliance 10 to include only one receptacle, with the receptacle defining the laundry treating chamber for receiving the laundry load to be treated. In addition, while the laundry treating appliance 10 is illustrated as a vertical-axis washing machine, it is within the scope of the invention for the laundry treating appliance 10 to be a horizontal-axis washing machine.

A liquid supply and recirculation system 42 may be provided to spray treating liquid, such as water or a combination of water and one or more wash aids, such as detergent, into the open top of the drum 30 and onto the top of a laundry load placed within the treating chamber 32. The liquid supply and recirculation system 42 may be configured to supply treating liquid directly from a household water supply 44 and/or from the tub 34 and spray it onto the laundry load. The liquid supply and recirculation system 42 may also be configured to recirculate treating liquid from the tub 34, including a sump 46, and spray it onto the top of the load.

A pump 48 may be housed below the tub 34. The pump 48 may have an inlet fluidly coupled to the sump 46 and an outlet configured to fluidly couple to either or both a household drain 50 or a recirculation conduit 52. In this configuration, the pump 48 may be used to drain or recirculate wash water in the sump 46, which is initially sprayed into the drum 30, flows through the drum 30, and then into the sump 46.

Additionally, the liquid supply and recirculation system 42 may differ from the configuration shown in FIG. 1, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid. Further, the liquid supply and recirculation system 42 need not include the recirculation portion of the system or may include other types of recirculation systems.

The laundry treating appliance 10 may further comprise a controller 54 coupled with the user interface 24 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10. Examples, without limitation, of cycles of operation include: wash, heavy duty wash, delicate wash, quick wash, refresh, rinse only, and timed wash. Any suitable controller 54 may be used. The specific type of controller is not germane to the invention. It is contemplated that the controller 54 may be a microprocessor-based controller that implements control software and sends/receives one or more electrical signals to/from each of the various components to effect the control software. As an example, proportional control (P), proportional integral control (PI), and proportional derivative control (PD), or a combination thereof, a proportional integral derivative control (PID control), and a fuzzy logic based control may be used to control the various components.

Figure 2:
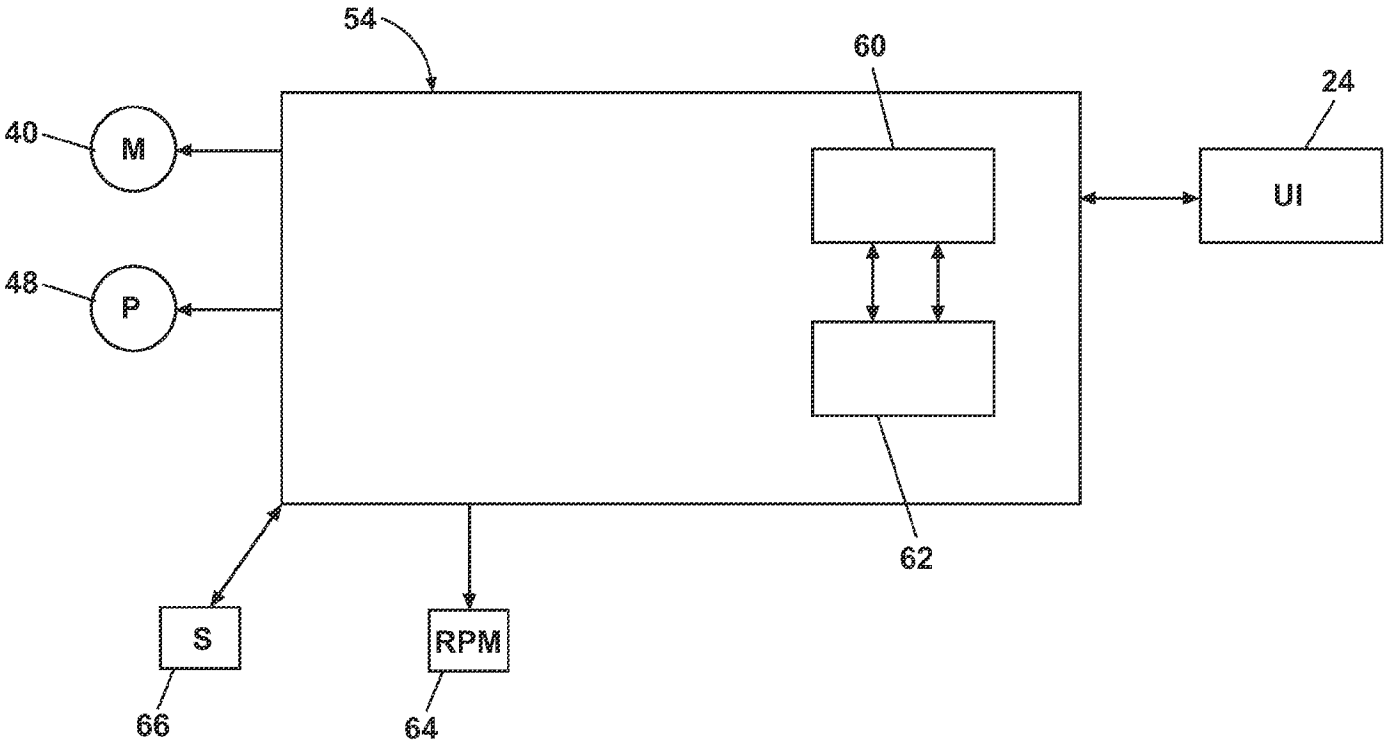
FIG. 2 is a schematic view of a control system of the laundry treating appliance of FIG. 1 according to a second embodiment of the invention.

As illustrated in FIG. 2, the controller 54 may be provided with a memory 60 and a central processing unit (CPU) 62. The memory 60 may be used for storing the control software that is executed by the CPU 62 in completing a cycle of operation using the laundry treating appliance 10 and any additional software. The memory 60 may also be used to store information, such as a database or table, and to store data received from one or more components of the laundry treating appliance 10 that may be communicably coupled with the controller 54.

The controller 54 may be operably coupled with one or more components of the laundry treating appliance 10 for communicating with and controlling the operation of the component to complete a cycle of operation. For example, the controller 54 may be coupled with the motor 40 for controlling the direction and speed of rotation of the drum 30 and the pump 48 for draining and recirculating wash water in the sump 46.

The controller 54 may also receive input from a speed sensor 64 for determining the speed of rotation of the drum 30 during a cycle of operation. The speed sensor 64 may be any suitable sensor, such as an optical sensor or a hall sensor, for example, for measuring the speed of the drum 30. In another example, the motor 40 may be configured to output a signal indicative of the speed of the drum 30. The speed sensor 64 may be programmed to provide a fixed number of speed measurements per revolution of the drum 30. The controller 54 may also receive input from one or more additional sensors 66, which are known in the art and not shown for simplicity. Non-limiting examples of additional sensors 66 that may by communicably coupled with the controller 54 include: a temperature sensor, a moisture sensor, a weight sensor, a position sensor and a motor torque sensor.

The previously described laundry treating appliance 10 may be used to implement one or more embodiments of a method of the invention. The embodiments of the method function to automatically determine an unbalance condition as a function of the fluctuations in the rotational speed of the drum 30 during a cycle of operation. The controller 54 may control the operation of the laundry treating appliance 10 as a function of the determined unbalance condition.

Figure 3:
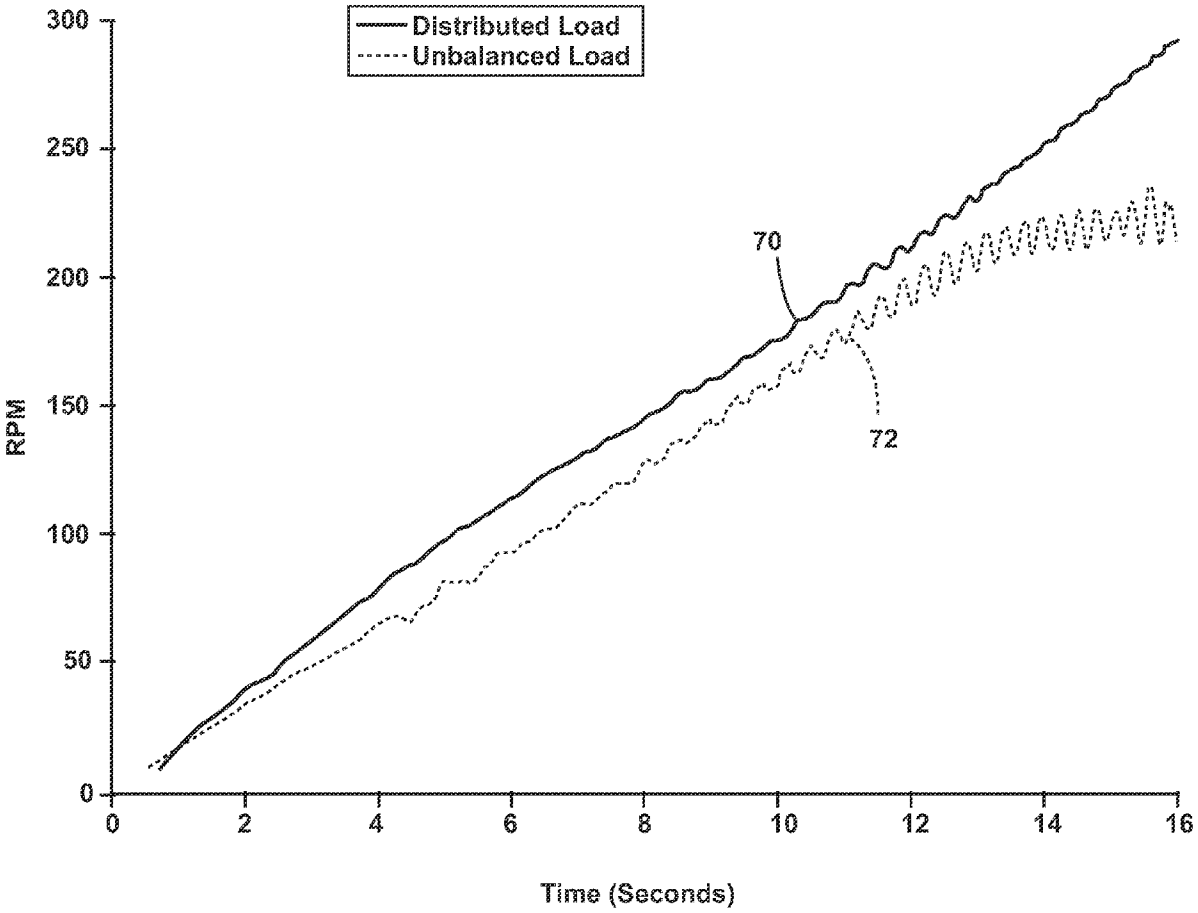
FIG. 3 is a plot of drum speed and time for a distributed and an unbalanced load according to a third embodiment of the invention.

FIG. 3 illustrates a plot of drum speed and time during an acceleration rate profile implemented by the controller 54 for a balanced or distributed load 70 and an unbalanced load 72. An unbalance condition may cause the drum 30 and tub 34 assembly to move within the cabinet 14 and potentially hit the sides and/or top of the cabinet 14 depending on the natural frequencies of the laundry treating appliance 10 and the rotational speed of the drum 30. This may result in increased noise and potential movement and damage of the laundry treating appliance 10.

It has been found that the drum speed fluctuates as a function of the amount of imbalance within the drum 30. The fluctuations in the drum speed may be correlated with an unbalance condition within the laundry treating appliance that may result in undesirable conditions. As may be seen in the plot, the unbalanced load 72 displays increasing fluctuation of the drum speed starting around 130 rpm, indicating the presence of an unbalance condition. The balanced load 70 exhibits a small amount of fluctuation, which may be related to natural frequencies of the rigid body platform of the laundry treating appliance 10. In addition, even a load that is generally considered to be balanced may experience some amount of unbalance.

Figure 4:
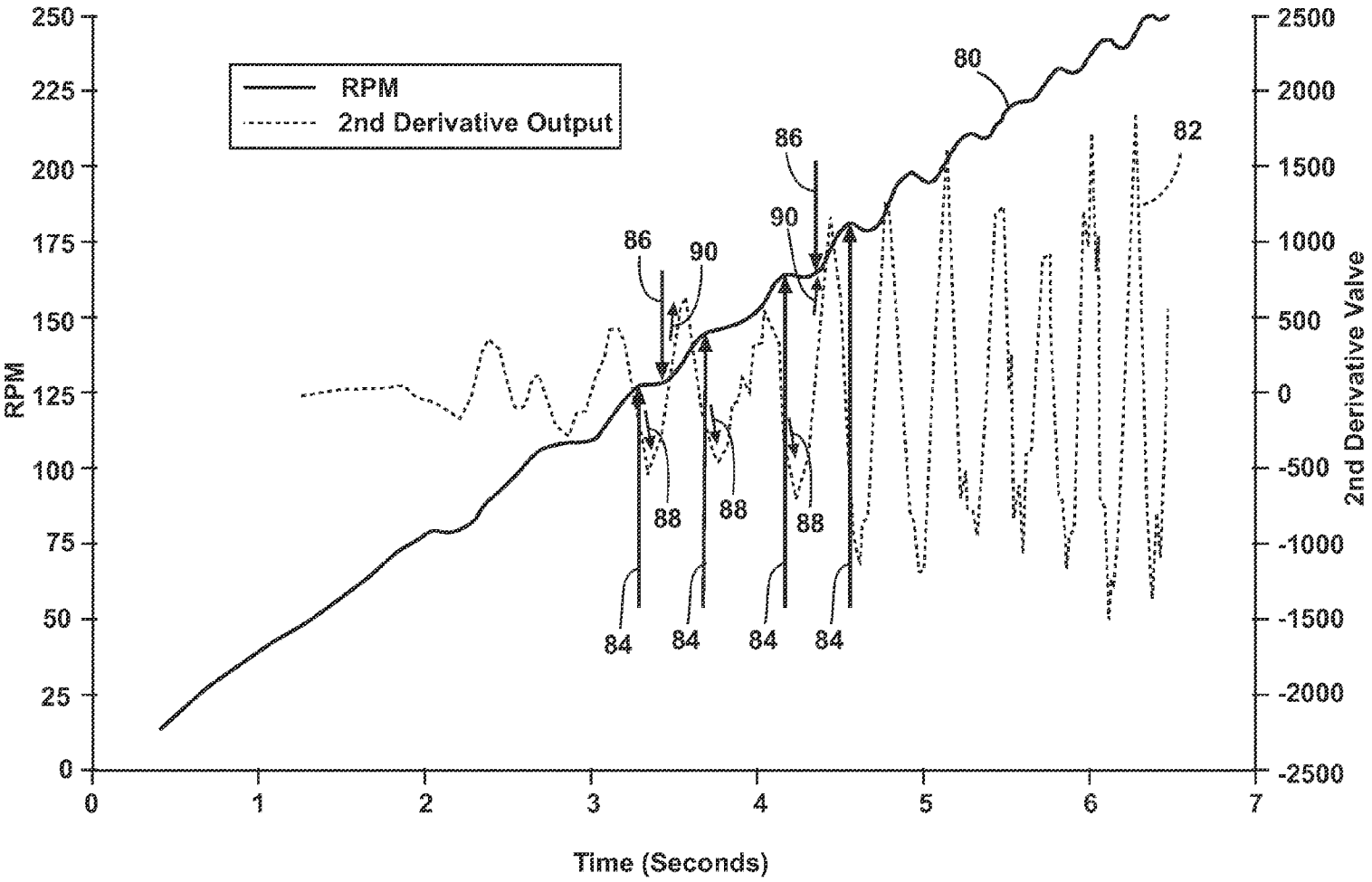
FIG. 4 is a plot of drum speed and time and a plot of a second derivative of the drum speed and time according to a fourth embodiment of the invention.

FIG. 4 illustrates a plot of an rpm signal versus time 80 for an unbalanced load and a plot of the corresponding second derivative versus time 82 during an acceleration rate profile implemented by the controller 54. As can be seen from the second derivative plot 82, the second derivative oscillates around 0 with positive and negative second derivative values. It has been found that the crossing of the second derivative values into negative and positive values may be correlated to the presence of an imbalance within the drum 30.

Arrows 84 and 86 generally indicate inflection points in the rpm signal 80, which correlates with the corresponding second derivative being near 0. Arrows 84 indicate a positive to negative inflection in the rpm signal 80, which indicates that the drum speed is accelerating up to the time which correlates with the inflection in the rpm signal 80. At this point in time, as illustrated by the corresponding second derivative plot 82, which shows decreasing second derivative values indicated by arrows 88, the rate of acceleration of the drum 30 is decreasing. The drum 30 may still be accelerating, but the rate of acceleration is decreasing, meaning that the drum 30 is not increasing in speed as quickly as it was just prior to the point in time of the inflection. In some cases, this trend in decreasing rate of acceleration may result in the drum 30 not increasing in speed as desired and potentially even slowing down.

Arrows 86 indicate a negative to positive inflection in the rpm signal 80, which indicates that the drum speed is starting to accelerate again. The corresponding second derivative values, indicated by arrows 90, start to increase, indicating that the rate of acceleration is also increasing. These positive to negative and negative to positive inflection points in the rpm signal, which may be analyzed by determining the second derivative of the rpm signal, may be used to determine an unbalance condition.

Figure 5:
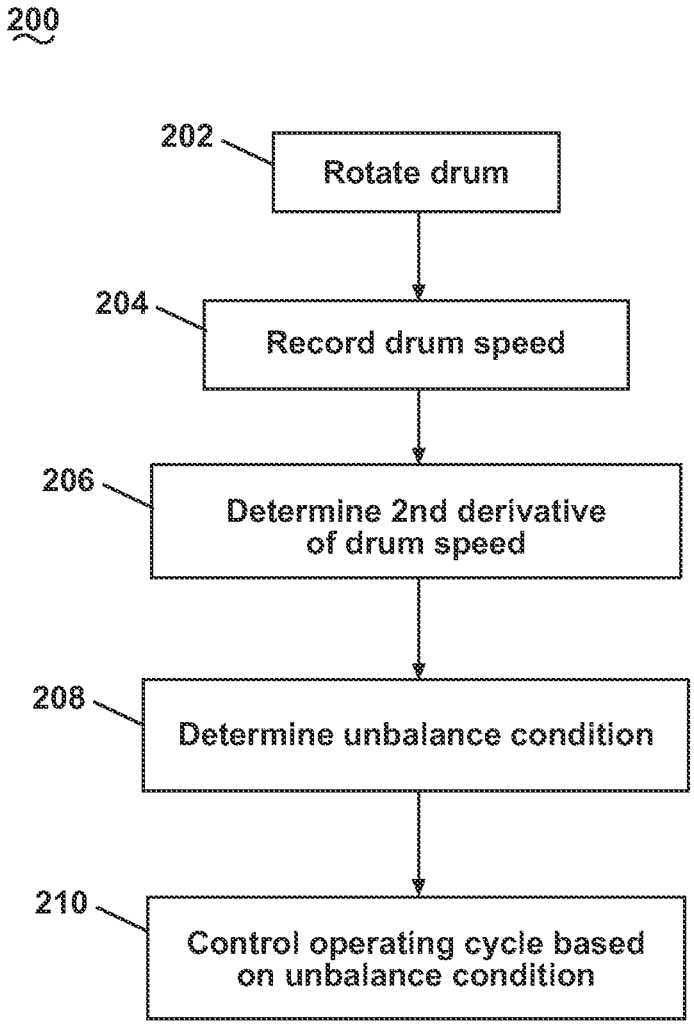
FIG. 5 is a flow chart illustrating a method of determining an unbalance condition according to a fifth embodiment of the invention.

Referring now to FIG. 5, a flow chart of one embodiment of a method 200 for determining an unbalance condition and controlling an operating cycle of the laundry treating appliance 10 according to the determined unbalance condition is illustrated. The method 200 is described in the context of rotating the drum 30 to a high speed so as to extract liquid from the laundry load; however, it is within the scope of the invention for the method 200 to be used at any point during a cycle of operation in which the drum 30 is rotated.

The method 200 starts with assuming that the user has placed one or more load items for treatment within the treating chamber 32 and selected a cycle of operation through the user interface 24. At 202 the controller 54 may apply a predetermined acceleration rate profile input to the motor 40 to rotate the drum 30 to a predetermined rotational speed during an acceleration phase. For example, the acceleration rate profile may include the controller 54 applying a constant rate of acceleration input to the motor 40 such that the drum 30 accelerates with a generally linear relation between drum speed and time, as illustrated by plot 70 in FIG. 3. Alternatively, the acceleration profile may include the drum 30 being accelerated in a non-linear manner during the acceleration phase of the speed profile. It is also within the scope of the invention for the controller 54 to apply multiple different predetermined rates of acceleration to the motor 40 in the course of accelerating the drum 30 to a predetermined rotational speed.

At 204, the controller 54 may receive input from the speed sensor 64 for each speed measurement made by the speed sensor 64 during rotation of the drum 30. The repeated speed measurements made by the speed sensor 64 may be used to form a speed signal of drum rotation speed as a function of time. The repeated speed measurements may be made according to any suitable predetermined sampling rate and may be stored in the memory 60 of the controller 54.

At 206, the controller 54 may calculate a second derivative of the repeated speed measurements received from the speed sensor 64 stored in the controller memory 60. The second derivative may be determined at 206 using software stored in the memory 60 directly from the drum speed. Alternatively, the software may use the drum speed to calculate a first derivative, $$\frac{dspeed}{dt},$$

change in speed over change in time t, which is essentially acceleration of the drum, and then the first derivative may be used to determine the second derivative $$\frac{d(dspeed/dt)}{dt}.$$

The second derivative is essentially the time rate of change of the acceleration (first derivative). The determined second derivative values may be stored in the controller memory 60.

According to one embodiment, if the determined second derivative is negative, the value of the determined second derivative may be added to an accumulator, which may be stored in the controller memory 60. The controller 54 may be programmed to calculate a running sum of the negative second derivative values added to the accumulator. While the embodiments of the invention are discussed in the context of accumulating the negative second derivative values, it will be understood that the method 200 may be implemented in a similar manner using the positive second derivative values.

At 208, an unbalance condition may be determined as a function of the negative second derivative values stored in the accumulator. The unbalance condition may be determined by comparing the sum of the negative second derivative values determined at 206 to a predetermined threshold value. The threshold value may be determined according to any suitable method. For example, the threshold value may be determined empirically by determining the accumulated second derivative sum for a plurality of different unbalance conditions.

As with all thresholds, it may be possible to mathematically arrange them as upper or lower limits, which may be satisfied/non-satisfied by exceeding, meeting or subceeding the threshold. For the purposes of this description, a threshold will be referred to as being satisfied when the corresponding condition for the threshold is met or exceeded, with it being understood that the threshold, depending on how it is mathematically arranged, could be exceeded, met or subceeded by the actual value.

When the accumulated second derivative value meets or exceeds the threshold value, the controller 54 may determine that an unbalance condition exists and that corrective action should be implemented. When the accumulated second derivative subceeds the threshold value, the controller 54 may determine that an unbalance condition requiring corrective action does not exist and the drum 30 may continue to accelerate to the desired speed.

At 210, the controller 54 may use the unbalance condition determined at 208 to control the operation of the laundry treating appliance 10. If it is determined at 208 that an unbalance condition exists, the controller 54 may control the laundry treating appliance 10 to implement corrective action. For example, power to the motor 40 may be cut and the drum 30 may be allowed to coast to approximately 0 rpm and then a redistribution cycle may be initiated. In a vertical axis washing machine, the redistribution cycle may include refilling the tub 34 to a high water level, agitating the load for a predetermined period of time, draining the water from the tub 34 and then attempting to accelerate the drum 30 to the desired speed again. Additional, non-limiting examples of controlling the operation of the laundry treating appliance 10 as a function of the determined unbalance condition include reducing or increasing the rotational speed of the drum 30, initiating ceasing rotation of the drum 30, for example, by cutting the power to the motor 40 or applying a braking mechanism, setting a rotational speed threshold for a spin phase of a wash cycle, implementing a rebalance cycle and combinations thereof.

The method described herein provides an inexpensive and robust method for determining when an unbalance condition exists and controlling the operation of the laundry treating appliance as a function of the determined unbalance condition.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of determining an unbalance condition of a load of laundry in a laundry treating appliance having a rotatable drum suspended within the laundry treating appliance by a suspension system and drivingly coupled with a motor operably coupled to a controller to control the motor and thereby control a rotational speed of the suspended drum, the method comprising:

accelerating the rotational speed of the suspended drum according to an acceleration rate profile having at least one predetermined rate of acceleration to define an acceleration phase;

repeatedly sensing the rotational speed of the suspended drum during the acceleration phase to form a speed signal;

inputting the speed signal to the controller;

repeatedly determining over time a second derivative of the speed signal;

accumulating the second derivatives;

determining an unbalance condition as a function of the accumulated second derivatives satisfying a predetermined threshold; and controlling the rotation of the suspended drum as a function of the determined unbalance condition.

2. The method of claim 1 wherein the accelerating the rotational speed of the suspended drum comprises the controller applying a constant rate of acceleration input to the motor.

3. The method of claim 1 wherein the repeatedly sensing the rotational speed of the suspended drum comprises sensing the rotational speed of the suspended drum at a predetermined sampling rate.

4. The method of claim 1 wherein the accumulating the second derivatives comprises accumulating the second derivatives having negative values.

5. The method of claim 4 wherein the accumulating the second derivatives comprises summing the second derivatives having negative values.

6. The method of claim 1 wherein the satisfying a predetermined threshold comprises exceeding a predetermined threshold.

7. The method of claim 1 wherein the controlling the rotation of the suspended drum comprises at least one of reducing the rotational speed, increasing the rotational speed, initiating ceasing rotation of the drum, setting a rotational speed threshold for a spin phase of a wash cycle, and implementing a rebalance cycle.

8. The method of claim 1 wherein sensing the rotational speed of the suspended drum comprises sensing the rotational speed of the motor.

9. A method of determining an unbalance condition of a load of laundry in a laundry treating appliance having a rotatable drum suspended within the laundry treating appliance and drivingly coupled with a motor operably coupled to a controller to control the motor and thereby control a rotational speed of the suspended drum, the method comprising:

accelerating the rotational speed of the suspended drum according to a predetermined acceleration rate profile in the controller to define an acceleration phase;

repeatedly receiving as input to the controller the rotational speed of the suspended drum during the acceleration phase;

repeatedly determining a second derivative output of the speed of the suspended drum from the repeated inputs of the rotational speed of the suspended drum;

determining an unbalance condition as a function of the repeated second derivative outputs; and controlling the rotation of the suspended drum as a function of the determined unbalance condition.

10. The method of claim 9 wherein the predetermined acceleration rate profile comprises a constant rate of acceleration.

11. The method of claim 9 wherein the repeatedly receiving as input to the controller comprises receiving input at a predetermined sampling rate.

12. The method of claim 9 wherein the determining an unbalance condition comprises accumulating the second derivative outputs having negative values.

13. The method of claim 12 wherein the accumulating the second derivative outputs comprises summing the second derivative outputs having negative values.

14. The method of claim 12 wherein the determining an unbalance condition comprises determining when the accumulated second derivative outputs satisfies a predetermined threshold.

15. The method of claim 14 wherein the predetermined threshold is satisfied when the accumulated second derivative outputs exceed the predetermined threshold.

16. The method of claim 9 wherein the controlling the rotation of the suspended drum comprises at least one of reducing the rotational speed, increasing the rotational speed, initiating ceasing rotation of the drum, setting a rotational speed threshold for a spin phase of a wash cycle, and implementing a rebalance cycle.

17. The method of claim 9, further comprising sensing the rotational speed of the suspended drum by sensing the rotational speed of the motor.

18. A laundry treating appliance comprising:

a rotatable drum suspended within the laundry treating appliance by a suspension system and defining a treating chamber for receiving a load of laundry;

a motor drivingly coupled with the suspended drum for rotating the suspended drum;

a speed sensor for repeatedly outputting a speed signal indicative of the speed of the suspended drum; and a controller operably coupled with the motor to accelerate a rotational speed of the suspended drum according to a predetermined acceleration rate profile and the speed sensor to receive as input the speed signal indicative of the speed of the suspended drum, wherein the controller is configured to repeatedly determine over time a second derivative of the speed signal input, accumulate the determined second derivatives and determine an unbalance condition as a function of the accumulated second derivatives satisfying a predetermined threshold.

19. The laundry treating appliance of claim 18 wherein the controller applies a constant rate of acceleration input to the motor to accelerate the rotational speed of the suspended drum.

20. The laundry treating appliance of claim 18 wherein the speed signal is output by the speed sensor at a predetermined sampling rate.

21. The laundry treating appliance of claim 18 wherein the motor comprises the speed sensor, the motor being further configured to output a signal indicative of the speed of the suspended drum.

22. The laundry treating appliance of claim 18 wherein the accumulated second derivatives comprise the second derivatives having negative values.

23. The laundry treating appliance of claim 22 wherein the controller is further configured to sum the accumulated second derivatives having negative values.

24. The laundry treating appliance of claim 18 wherein the controller is configured to determine that the predetermined threshold is satisfied when the accumulated second derivatives exceed the predetermined threshold.

25. The laundry treating appliance of claim 18 wherein the controller is further configured to control the rotation of the suspended drum as a function of the determined unbalance condition.

26. The laundry treating appliance of claim 25 wherein the controller is configured to control at least one of reducing the rotational speed, increasing the rotational speed, initiating ceasing rotation of the drum, setting a rotational speed threshold for a spin phase of a wash cycle, and implementing a rebalance cycle as a function of the determined unbalance condition.

* * * * *